United States Patent [19]

Yokoyama

[11] Patent Number: 4,854,640

[45] Date of Patent: Aug. 8, 1989

[54] APPARATUS FOR RAISING SEAT OF CHAIR

[75] Inventor: Toshio Yokoyama, Tokyo, Japan

[73] Assignee: Kabushiki Raisha Kotobuki, Tokyo, Japan

[21] Appl. No.: 167,523

[22] Filed: Mar. 14, 1988

[30] Foreign Application Priority Data

Nov. 6, 1987 [JP] Japan ..... 62-169660

[51] Int. Cl.[4] ..... A47C 1/12

[52] U.S. Cl. ..... 297/333; 297/335

[58] Field of Search ..... 297/331, 332, 333, 335, 297/336; 248/592

[56] References Cited

U.S. PATENT DOCUMENTS

| | | | |
|---|---|---|---|
| 2,272,298 | 2/1942 | Hanson | 297/333 |
| 2,280,298 | 4/1942 | Nordmark | 297/333 |
| 2,312,638 | 3/1943 | Gedris | 297/333 |
| 2,347,931 | 5/1944 | Bromagem | 297/333 |
| 2,582,599 | 1/1952 | Nordmark | 297/333 |
| 2,582,600 | 1/1952 | Nordmark | 297/333 |
| 3,156,501 | 11/1964 | Harris | 297/333 |
| 3,690,726 | 9/1972 | Van Ryn | 297/332 |
| 3,727,975 | 4/1973 | Anderson | 297/332 |

FOREIGN PATENT DOCUMENTS

| | | | |
|---|---|---|---|
| 241095 | 10/1925 | United Kingdom | 297/333 |

*Primary Examiner*—Peter A. Aschenbrenner

*Assistant Examiner*—Thomas A. Rendos

*Attorney, Agent, or Firm*—Oldham & Oldham

[57] ABSTRACT

An aparatus for raising a seat of a chair includes a pair of arms fixedly secured to both sides of the seat, stationary shaft extending between both legs of the chair, a position determining sleeve turnably mounted on the stationary shaft, a first coil spring fitted onto a larger diameter sleeve portion of the position determining sleeve and a second coil spring fitted onto a smaller diameter sleeve portion of the position determining sleeve. One end of the first coil spring having a higher intensity of resilient force than that of the second coil spring is engaged to the stationary shaft and other end of the same is engaged to the intermediate portion of the position determining sleeve so that the seat is normally urged to turn to the raised neutral position under the effect of resilient force of the first coil spring. One end of the second coil spring is engaged to the other end of the first coil spring and other end of the same is engaged to a part of the arm so that the seat is normally urged to turn to the neutral position in the opposite direction to the first coil spring. The position determining sleeve is formed with an opposed pair of tongues for determining a range of turning movement of the seat while a reference bolt is extended in an area as defined between both the tongues.

6 Claims, 5 Drawing Sheets

APPARATUS FOR RAISING SEAT OF CHAIR

BACKGROUND OF THE INVENTION

The present invention relates to an apparatus for raising a seat of a chair and more particularly to an apparatus for raising a seat of a chair wherein a number of chairs arranged in a side-by-side relation are automatically raised under the effect of resilient force of spring means to provide a wide transverse passage between the adjacent arrays of chairs when they are not in use.

Generally, to accommodate audiences as many as possible in a theater, public hall or the like, a number of chairs are connected to one another in the side-by-side relation in the transverse direction. Further, to assure that audiences walk easily, the chairs are divided into plural blocks each of which is defined by longitudinal passages extending toward a stage and transverse passages extending in the transverse direction at a right angle relative to the aforesaid longitudinal direction. However, the transverse passage between the adjacent arrays of chairs in each of the blocks are usual narrow. So as to allow audiences to easily walk in the transverse direction to leave the theater, public hall or the like after a certain performance is over, conventional chairs are so constructed that they assume a completely raised position when they are not in use.

Since each of the chairs is constructed in the above-described manner, a conventional apparatus for raising a seat of a chair has the following problems.

Specifically, to assure that audiences easily walk on the transverse passage between the adjacent arrays of chairs to leave a theater after completion of a performance, each of the seats of the chairs is so constructed that they assume a completely raised position when they are not in use. Thus, when audiences sit on chairs to enjoy a performance, it is necessary to turn the seats from the completely raised state to the seated state against resilient force of spring means by a long angular distance. This means that a high intensity of labor power is required, accompanied by troublesome operation.

SUMMARY OF THE INVENTION

The present invention has been made with the foregoing background in mind and its object resides in providing an apparatus for raising a seat of a chair which assures that a seated state is easily obtained with a small amount of labor power by a short angular distance before a performance is practiced and moreover a wide transverse passage between the adjacent arrays of chairs is obtained merely by slightly turning a seat in the backward direction after the performance is over.

To accomplish the above object, the present invention provides an apparatus for raising a seat of a chair comprising a pair of arms having a L-shaped cross-sectional form, the arms being disposed on both sides of the seat to serve as skeleton therefor, a stationary shaft extending between both legs of the chair to be fixedly secured thereto, a position determining sleeve turnably mounted on the stationary shaft, the position determining sleeve being composed of a first sleeve portion disposed by the vertical portion of one of the arms, a second sleeve portion disposed remote from the vertical portion of the same and an intermediate portion located between the first sleeve portion and the second sleeve portion, first spring means fitted onto the first sleeve portion and the second sleeve portion, first spring means fitted onto the first sleeve portion of the position determining sleeve to normally urge the seat in such a direction that the seat is raised up, one end of the first spring means being engaged to the stationary shaft and other end of the same being engaged to the position determining sleeve, and second spring means fitted on the second sleeve portion of the position determining sleeve to normally urge the seat toward the neutral position in the opposite direction to the first spring means, the second spring means having a lower intensity of resilient force than that of the first spring means, one end of the second spring means being engaged to a part of the first spring means and other end of the same being engaged to a part of the arm.

Both ends of the stationary shaft are formed to have a square cross-sectional shape so that it is fixedly secured to the legs of the chair.

Preferably, the first spring means comprises a first coil spring which is produced by coiling a steel wire and of which turns are arranged one after another in a closely contacted state. One end of the first coil spring is bent to form a ring through which a reference bolt is inserted so as to allow the one end of the first coil spring to be fixed to the stationary shaft in cooperation with a nut, while other end of the first coil springs extends linearly in parallel with the stationary shaft so that it is inserted through one of a plurality of spring holes which are provided in the intermediate portion of the position determining sleeve in order that it is engaged to the latter.

Similarly, the second spring means comprises a second coil spring which is produced by coiling a steel wire and of which turns are arranged one after another in a closely contacted state. One end of the second coil spring is bent in the form of a hook so as to allow the one end of the second coil spring to be engaged to the linear end of the first coil spring, while other end of the same is bent in the form of a hook so as to allow the other end of the second coil spring to be engaged to an arm pin which extends from the vertical portion of the arm.

The intermediate portion of the position determining sleeve includes a first raised part and a second raised part. The first raised part is adapted to abut against the arm pin so as to limit turning movement of the arm, while the second raised portion is formed with a plurality of spring holes through which the linear end of the first coil spring is selectively inserted to adjust an intensity of resilient force of the first coil spring.

Further, the second sleeve portion of the position determining sleeve is formed with an opposed pair of tongues so that a range of turning movement of the arm is determined by a remote angle between the tongues while the reference bolt extends in the space as defined between the tongues.

Since the apparatus of the invention is constructed in the above-described manner, when the chair is not used, the seal can be held in an immovable state at the intermediate position located before a completely raised state under the effect of resilient supporting force of the first coil spring which has a higher intensity of resilient force than that of the second coil spring and of which twisting movement is limited by means of the position determining sleeve. At this moment, resilient supporting force of the first coil spring is kept in proper balance with resilient supporting force of the second coil spring.

Next, when an audience sits on the seat, the latter is turned forwardly against resilient supporting force of the first coil spring by depressing operation, causing the seat to turn within a range of turning movement as defined by means of the position determining sleeve. Thus, the seat which has assumed the original neutral position is shifted to the seated state with a little amount of labor force and by short turning operation. At this moment, the first coil spring is loaded with the highest level of resilient restorative force. Accordingly, when the seated state is interrupted after completion of usage of the seat, the seat is caused to automatically return to the original neutral position easily and quickly under the effect of resilient supporting force of the first spring.

Next, when the audience walks on the passage between the adjacent arrays of seats after the seat returns to the original neutral position, he slightly pushes the seat rearwardly against resilient supporting force of the second coil spring whereby the seat is turned further from the neutral position to the completely raised position without any influence caused by resilient supporting force of the first spring. Consequently, he can walk on a wide transverse passage between the adjacent arrays of chairs.

These and other objects, features and advantages of the present invention will become readily apparent from reading of the following description which has been made in conjunction with the accompanying drawings.

BRIEF DESCRIPTION OF THE DRAWINGS

The present invention will be illustrated in the following drawings in which.

DESCRIPTION OF THE PREFERRED EMBODIMENT

Now, the present invention will be described in a greater detail hereunder with reference to the accompanying drawings which illustrate a preferred embodiment thereof.

Figure 1:
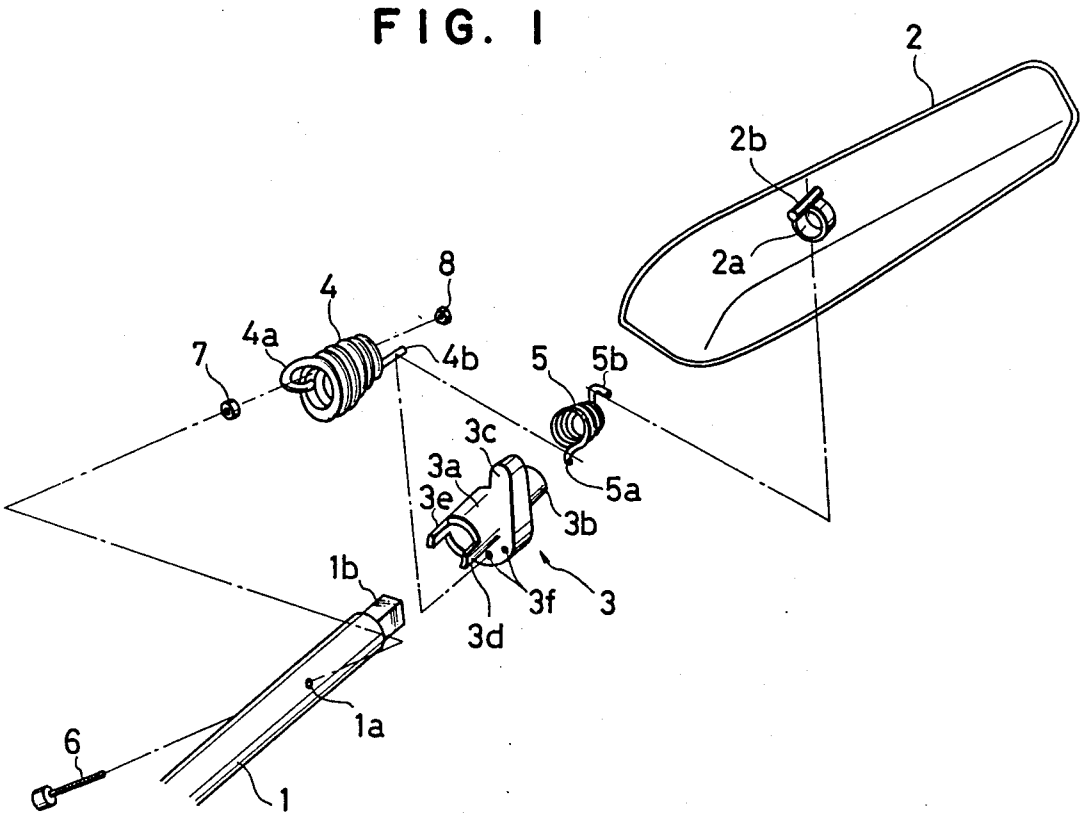
FIG. 1 is a perspective view of an apparatus for raising a seat of a chair in accordance with an embodiment of the invention, shown in a disassembled state.
Figure 2:
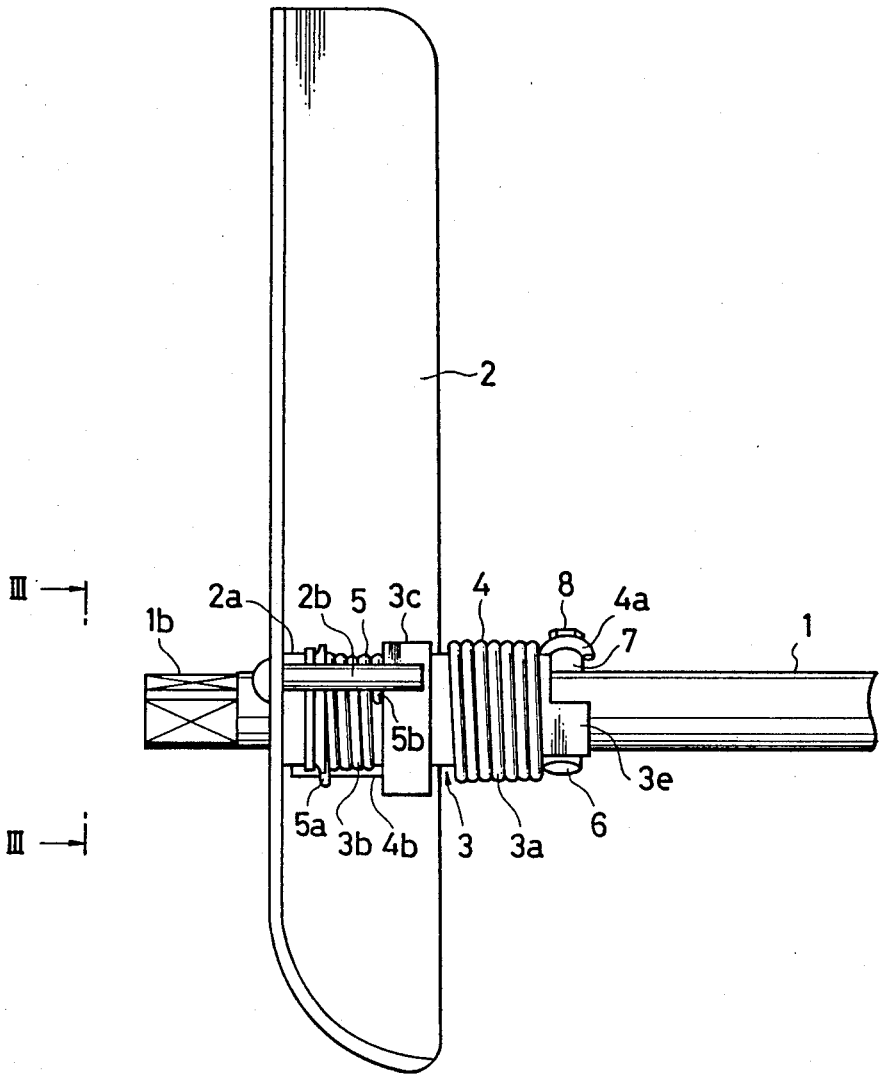
FIG. 2 is a plan view of the apparatus in FIG. 1, illustrating an assembled state thereof.
Figure 3:
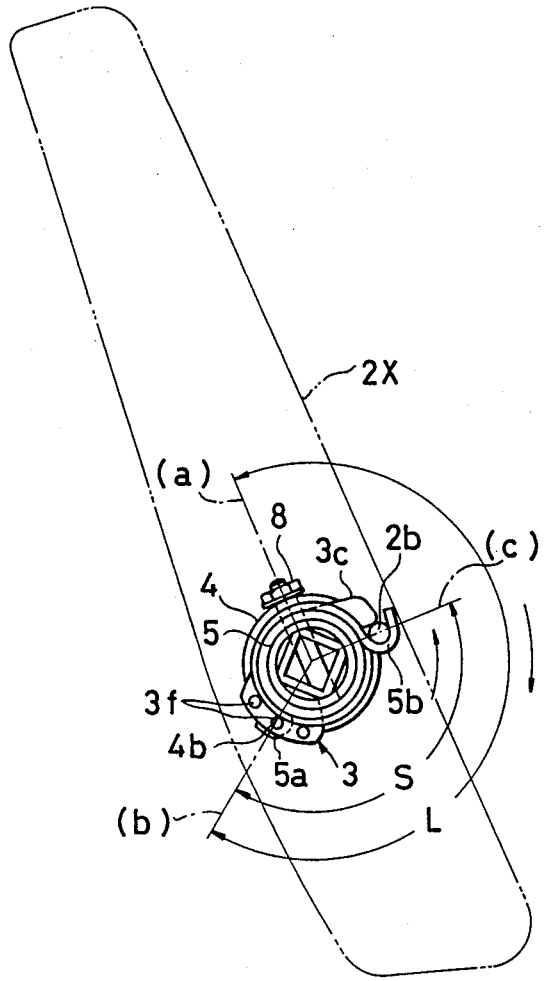
FIG. 3 is a side view of the apparatus as seen from arrow marks III in FIG. 2 on the assumption that an arm is represented by a chain line, particularly illustrating that main components constituting the apparatus assume a neutral state.

As shown in FIGS. 1 to 3, a rod-shaped stationary shaft 1 of which both ends have a square cross-sectional form is extended between both legs of a chair which is not shown in the drawings. A bolt hole 1*a* through which a reference bolt 6 to be described later is inserted is formed at the position in the vicinity of the shaft end 1*b* having a square cross-sectional shape. The chair is firmly built by fixedly fitting the shaft ends 1*b* into the corresponding square holes of the chair legs.

An arm 2 having a L-shaped cross-sectional form to serve as skeleton for a seat 2X on both sides of the latter is turnably fitted to the stationary shaft 1 by means of a bearing 2*a* at the position in the vicinity of the shaft end 1*b*. The bearing 2*a* is secured to a vertical portion of the arm 2 and the stationary shaft 1 is projected through the bearing 2*a*. Further, an arm pin 2*b* is extended inwardly in parallel with the stationary shaft 1 at the position located above the bearing 2*a* so that it abuts against a raised portion 3*c* of a position determining sleeve 3 to be described later and a free end 5*b* of a second coil spring 5 is engaged to the arm pin 2*b*.

The position determining sleeve 3 is rotatably mounted on the stationary shaft 1 so as to turn within a predetermined angular range. Specifically, the position determining sleeve 3 is constructed in the following manner. As shown in FIG. 1, the position determining sleeve 3 is formed with a shaft hole through which the stationary shaft 1 is loosely fitted and its one side (located close to the central part of the seat 2X) constitutes a larger diameter sleeve portion 3*a* on which a first coil spring 4 having a high intensity of resilient force is fitted, while its other side (located close to the arm 2) constitutes a smaller diameter sleeve portion 3*b* on which a second spring 5 having a lower intensity of resilient force than that of the first spring 4 is fitted. The raised portion 3*c* of which one side comes in engagement with the arm pin 2*b* and of which other side is formed with a plurality of spring holes 3*f* is disposed between both the sleeve portions 3*a* and 3*b*. Consequently, the position determining sleeve 3 is composed of the larger diameter sleeve portion 3*a*, smaller diameter sleeve portion 3*b* and raised portion 3*c* located between the larger diameter sleeve portion 3*a* and the smaller diameter sleeve portion 3*b*. It should be noted that the fore end side of the larger diameter sleeve portion 3*a* is formed with an opposed pair of tongues 3*d* and 3*e* by cutting operation. The position determining sleeve 3 as constructed in the above-described manner is turnably mounted on the stationary shaft 1 at the position in the vicinity of the bolt hole 1a. Further, it should be noted that the position determining sleeve 3 is turnably mounted to turn within a range of compression angle M of the first spring 4 while the reference bolt 6 is inserted through the cutout area between the tongues 3*d* and 3*e*. Accordingly, the limitative range of turning movement of the position determining sleeve 3 is determined by engagement of the tongues 3*d* and 3*e* to the reference bolt 6 (see FIG. 4).

Figure 4:
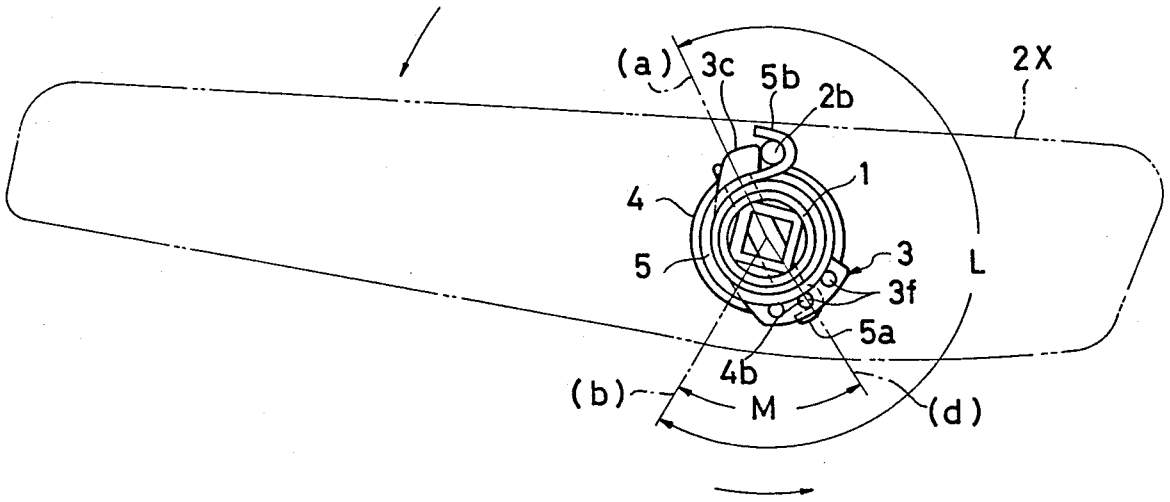
FIG. 4 is a side view of the apparatus as seen from the arrow marks III in FIG. 2 on the assumption that the arm is illustrated by a chain line, particularly illustrating that the main components assume a seated state.

As shown in FIGS. 1 and 2, one free end 4*a* of the first spring 4 which is produced by coiling a steel wire having a large diameter and of which turns are arranged one after another in a closely contacted state is firmly engaged to the reference bolt 6 on the larger diameter sleeve portion 3*a* corresponding to the right-hand side of the position determining sleeve 3 by fitting a ring portion of the free end 4*a* onto a part of the reference bolt 6 projected outwardly of the stationary shaft 1 with a spring washer 7 interposed therebetween and then tightening a nut 8. Further, a linear part of other free end 4*b* of the first spring 4 is selectively inserted through one of the spring holes 3*f*. The reason why a plurality of spring holes 3*f* are formed consists in that an intensity of resilient supporting force of the first spring 4 can be adjusted as required by selecting one of them. Thus, the first spring 4 is normally urged in such a direction that the seat 2X is raised up so that resilient supporting force effective in the clockwise direction is accumulated in an area between the position where the reference bolt 6 assumes (a) point and the position where the spring hole 3*f* assumes (b) point as shown in FIGS. 3 and 4. Accordingly, when the seat 2X is not in use, the apparatus has a first spring neutral angle L which makes it possible that the seat 2X is automatically raised up to the neutral position shown in FIG. 3 which corresponds to the position located before the seat 2 is fully raised up. Namely, since the position of the spring hole 3*f* is caused to shift from (b) point in the original state to (d) point when the seat 2X is turned forwardly to the seated state as shown in FIG. 4, resilient supporting force is increased by a first spring compression angle M ranging from (b) point to (d) point, whereby the seat 2X is automatically raised up to the neutral position as shown in FIG. 3 under the effect of restorative resilient force corresponding to the first spring compression angle M.

Figure 5:
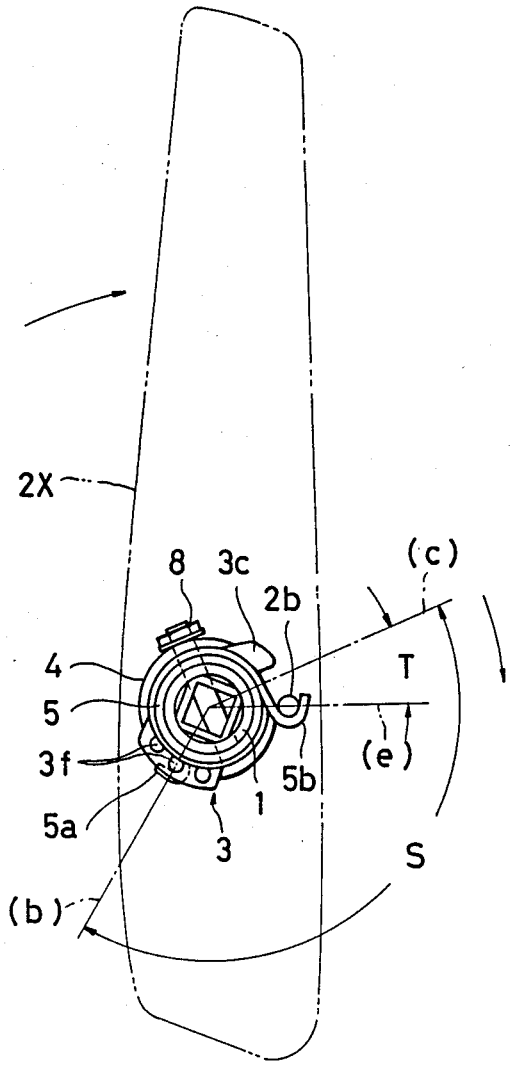
FIG. 5 is a side view of the apparatus as seen from the arrow marks III in FIG. 2 on the assumption that the arm is represented by a chain line, particularly illustrating that the main components assume a completely raised state.

As shown in FIGS. 1 and 2, a hook part of one free end 5*a* of a second coil spring 5 which is produced by coiling a steel wire having a smaller diameter than that of the first spring 4 and of which turns are arranged one after another in a closely contacted state is engaged to the linear fore end 4*b* of the first spring 4 which has been extended through the spring hole 3*f* of the position determining sleeve 3, at the smaller diameter sleeve portion 3*b* corresponding to the left-hand side of the position determining sleeve 3. Further, a hook part of other free end 5*b* of the second spring 5 is engaged to the arm pin 2*b* of the arm 2 which serves as skelton for the seat 2X. Thus, the second spring 5 is normally urged to assume the neutral state of the seat 2X in the opposite direction to the first spring 4 whereby resilient supporting force is accumulated in the anticlockwise direction in an area between the position where the spring hole 3*f* assumes (b) point and the position where the arm pin 2*b* assumes (c) point, as shown in FIGS. 3 and 5. Accordingly, when the seat 2X is not in use, the apparatus has a second spring neutral angle S against resilient supporting force of the first spring 4 until the neutral position as shown in FIG. 3 corresponding to the position located before the completely raised state of the seat 2X is assumed. Namely, as the seat 2X is slightly pushed against resilient supporting force of the second spring 5 when it assumes the neutral position as shown in FIG. 3, the arm pin 2*b* which has assumed (c) point in the original state is caused to shift to (e) point. Thus, resilient supporting force is increased by a second spring compression angle T ranging from (c) point to (e) point whereby the seat 2X is automatically returned from the completely raised position shown in FIG. 5 to the neutral position shown in FIG. 3 under the effect of resilient restorative force corresponding to the second spring compression angle T.

Since an intensity of resilient force of the first spring 4 for supporting the seat 2X is higher than that of the second spring 5 and the turning movement of the position determing sleeve 3 is limited within the range determined by remote angle (first spring compression angle M) between the tongues 3*d* and 3*e* of the position determining sleeve 3, it is assured that the seat 2X is maintained under the effect of resilient supporting force of the first spring 4 in an immovable state at the neutral position located before the completely raised state is assumed, as shown in FIG. 3.

Next, as the seat 2X is turned forwardly in the anticlockwise direction as shown in FIG. 4 against resilient supporting force of the first spring 4 when the seat 2X which has assumed the neutral position is seated, it is caused to turn within the limitative turning range determined by the position determining sleeve 3 (the range corresponding to the first spring compression angle M derived from the remote angle between the tongues 3*d* and 3*e*) with the result that the seat 2X which has assumed the neutral position in the original state can be shifted to a seated state with a small amount of labor force and by short turning movement.

At this moment, the first spring 4 is loaded with the highest resilient restorative force within the first spring compression angle M shown in FIG. 4. Accordingly, when usage of the chair is completed and the seated state is interrupted, the seat 2X can automatically return to the neutral position in the original state as shown in FIG. 3 easily and quickly under the effect of resilient supporting force of the first spring 4.

When the audiences walk on a passage between the adjacent arrays of chairs after the seat 2X returns to the original state automatically, the seat 2X which is held at the neutral position is slightly pushed in the rearward direction against resilient supporting force of the second spring 5. Thus, the seat 2X is raised up further from the neutral position to the completely raised position by slight pushing operation without any influence caused by the first spring 4. Consequently, a wide transverse passage between the adjacent arrays of chairs can be obtained easily and thereby audiences can walk without any hindrance encountered.

As is apparent from the above description, the apparatus of the invention is substantially characterized in that a position determining sleeve is turnably mounted on a stationary shaft at the position located inwardly of an arm, a first coil spring is disposed on one side of the position determining sleeve so as to urge a seat in such a direction that the seat is raised up, one end of the first coil spring being engaged to the stationary shaft and other end of the same being engaged to the position determining sleeve, and a second coil spring is disposed on other side of the position determining sleeve so as to urge the seat toward a neutral state in the opposite direction to the first spring, one end of the second spring being engaged to a part of the first coil spring and other end of the same being engaged to the arm. Owing to the construction of the apparatus made in that way, when chairs in a theater, public hall or the like are used to enjoy a performance, a seated state can be obtained smoothly and easily with a small amount of labor force and by short turning movement of the chairs. Further, a wide transverse passage can be easily obtained merely by slightly pushing the chairs in the rearward direction after completion of the performance. Thus, audiences can enjoy a comfortable feeling of usage of seats as well as a smooth feeling of walking on a transverse passage.

While the present invention has been described above only with respect to a single preferred embodiment, it should of course be understood that it should not be limited only to this but various changes or modifications may be made in a suitable manner without any departure from the spirit and scope of the invention as defined by the appended claims.

What is claimed is:

1. An apparatus for raising a seat of a chair comprising:

a pair of spaced arms each having an L-shaped cross-section form including a vertical portion, said arms being adapted to receive a pivotally mounted seat therebetween, a stationary shaft extending between said arms, a position determining sleeve turnably mounted on said stationary shaft, said position determining sleeve being composed of a first sleeve portion disposed remote from the vertical portion of one of the arms, a second sleeve portion disposed by the vertical portion of the arm and an intermediate portion located between said first sleeve portion and said second sleeve portion, first spring means fitted onto the first sleeve portion of the position determining sleeve to normally urge the seat in such a direction that the seat is raised up to a neutral nonuse position, one end of said first spring means being engaged to the stationary shaft and the other end of the same being engaged to the position determining sleeve, and second spring means fitted on the second sleeve portion of the position determining sleeve to normally urge the seat toward the neutral position in the opposite direction to the first spring means, said second spring means having a lower intensity of resilient force than that of the first spring means, one end of the second spring means being engaged to a part of the first spring means and other end of the same being engaged to a part of the arms.

2. The apparatus of claim 1 wherein both ends of the stationary shaft are formed to have a square cross-sectional shape.

3. The apparatus of claim 1 wherein the first spring means comprises a first coil spring which is produced by coiling a steel wire and of which turns are arranged one after another in a closely contacted state, one end of said first coil spring being bent to form a ring through which a reference bolt is inserted so as to allow said one end of the first coil spring to be fixed to the stationary shaft in cooperation with a nut, said reference bolt extending through the shaft, said other end of the first coil spring extending linearly in parallel with the stationary shaft so that it is inserted through one of a plurality of spring holes which are provided in the intermediate portion of the position determining sleeve in order that it is engaged to the latter.

4. The apparatus of claim 1 wherein said first spring means comprises a coil spring, said other end of said first spring means forms a linear end and the second spring means comprises a second coil spring which is produced by coiling a steel wire and of which turns are arranged one after another in a closely contacted state, one end of said second coil spring being bent in the form of a hook so as to allow said one end of the second coil spring to be engaged to the linear end of the first coil spring and other end of the same being bent in the form of a hook so as to allow said other end of the second coil spring to be engaged to an armpin which extends from the vertical portion of the arm.

5. The apparatus of claim 4 wherein intermediate portion of the position determining sleeve includes a first raised part and a second raised part, said first raised part being adapted to abut against the armpin so as to restrict turning movement of the arm and said second raised part being formed with a plurality of spring holes through which the linear end of the first coil spring is selectively inserted to adjust an intensity of resilient force of the first coil spring.

6. The apparatus of claim 1 wherein the first sleeve portion of the position determining sleeve is formed with an opposed pair of tongues extending in parallel with the stationary shaft so that a range of turning movement of the arm is determined by a remote angle between said tongues while a reference bolt extends in a space as defined between the tongues.

* * * * *